US009364947B2

(12) United States Patent
Wang

(10) Patent No.: US 9,364,947 B2
(45) Date of Patent: Jun. 14, 2016

(54) STORAGE COMPARTMENT SLEEVE STRUCTURE IN A TOOL SHANK

(71) Applicant: Yeo-Ming Wang, Taipei (TW)

(72) Inventor: Yeo-Ming Wang, Taipei (TW)

( * ) Notice: Subject to any disclaimer, the term of this patent is extended or adjusted under 35 U.S.C. 154(b) by 267 days.

(21) Appl. No.: 14/150,976

(22) Filed: Jan. 9, 2014

(65) Prior Publication Data

US 2015/0190918 A1 Jul. 9, 2015

(51) Int. Cl.
*B25G 1/08* (2006.01)
*B25G 1/04* (2006.01)

(52) U.S. Cl.
CPC ..... *B25G 1/085* (2013.01); *B25G 1/043* (2013.01)

(58) Field of Classification Search
CPC ..... B25G 1/08; B25G 1/085; B25G 1/043; B25G 1/04; B25B 13/06
USPC ..... 81/177.4, 490
See application file for complete search history.

(56) References Cited

U.S. PATENT DOCUMENTS 2,869,410 A * 1/1959 Prichard ..... B25B 13/463 81/177.2
3,526,040 A * 9/1970 Young ..... G01B 3/08 33/809
4,047,821 A * 9/1977 Hoke ..... B25G 1/04 24/265 B
4,440,517 A * 4/1984 Potter ..... F16B 7/105 16/429
4,581,958 A * 4/1986 Shull ..... B25G 1/043 403/109.3
5,109,737 A * 5/1992 Raber ..... B25G 1/043 81/177.1
5,363,727 A * 11/1994 Barth ..... B25G 1/043 81/177.2
6,131,490 A * 10/2000 Lee ..... B25B 13/461 81/177.2
6,209,428 B1 * 4/2001 Anderson ..... B25B 15/02 81/177.4
6,405,618 B1 6/2002 Sorensen et al.
8,065,938 B1 * 11/2011 Kravitch ..... B25B 13/48 81/177.2
8,266,989 B2 * 9/2012 Hu ..... B25B 13/461 81/177.1
8,291,793 B2 * 10/2012 Wang ..... B25B 13/08 16/110.1
8,297,155 B2 * 10/2012 Hu ..... B25B 23/0035 403/328
8,424,424 B1 * 4/2013 Kravitch ..... B25B 13/48 81/177.2
8,739,662 B2 * 6/2014 Huang ..... B25G 1/043 408/95
2008/0083304 A1 * 4/2008 Finn ..... B25B 13/461 81/177.4
2012/0174417 A1 * 7/2012 Huang ..... A01G 3/0251 30/312
2013/0098212 A1 * 4/2013 Ingersoll ..... B25G 1/043 81/177.2
2014/0345428 A1 * 11/2014 Buchanan ..... B25G 1/043 81/177.2

FOREIGN PATENT DOCUMENTS

TW M434651 U1 8/2012

* cited by examiner

*Primary Examiner* — David B Thomas
(74) *Attorney, Agent, or Firm* — Muncy, Geissler, Olds & Lowe, P.C.

(57) ABSTRACT

A storage compartment sleeve structure in a tool shank comprising: an operation unit with a pin; a tool shank linking the operation unit and developing at least a tool compartment; a tool shank sleeve enveloping the tool shank and developing a positioning through hole securely penetrated by the pin. As such, the storage compartment sleeve structure in a tool shank is easily and fast opened or closed for removal or accommodation of spare parts and provides a tool shank with flexible lengths based on operation states for adjustable and selectable torque.

9 Claims, 7 Drawing Sheets

STORAGE COMPARTMENT SLEEVE STRUCTURE IN A TOOL SHANK

BACKGROUND OF THE INVENTION

1. Field of the Invention

The present disclosure relates to a sleeve structure, particularly a sleeve structure with storage compartments in a tool shank as a sheath for satisfactory convenience, operability and efficiency.

2. Descriptions of the Related Art

An ordinary hand tool such as screw driver, tongs, socket wrench and hammer common in families or operated by workers is usually divided into two sections, that is, an operation unit (anterior part) and a shank (posterior part) wherein the operation unit can be a screw driver, a tongs, a socket wrench or a hammer as per works to be performed. According to current deign, the shank of an existing hand tool comprises a storage compartment in which some components easily to be used (e.g., screws, iron nails, sleeves, etc.) can be held. As shown in Patent No. M434651, a conventional storage compartment structure in a tool shank as one part of a socket wrench comprises: a grip cover which comprises a shell-like grip part developing an accommodation space inside and a joint part linking the grip part atop and having an assembly hole; an accommodation cover whose front end links the grip part's top end and back end is coupled with the grip part's rear end so that the grip part of the grip cover overlaps the shell-like accommodation cover with a loading space developed inside and an opening contour matching the grip part's contour; a joining head corresponding to the assembly hole on the joint part of the grip cover.

The conventional storage compartment structure in a tool shank, which is one part of a socket wrench with a number of portable sleeves available and provides a grip cover encasing an accommodation cover, still has some drawbacks as follows: For example, a user who tries to expose the loading space in the conventional storage compartment structure in a tool shank usually struggles to hold and loosen the accommodation cover with one hand first and lift the grip cover with the other hand because of modest lateral areas of both the grip cover and the accommodation cover. The areas of both the grip cover and the accommodation cover to be grasped should be expanded for convenient operation but aggravates difficulty in manipulation because of a tool shank's increased volume. Moreover, the conventional storage compartment structure in a tool shank should be further corrected because either the grip cover or the accommodation cover with a fixed length fails in lengthening a tool shank for saving strength or overcoming difficulty during application of a greater torque in some specific cases. Accordingly, how to get rid of those drawbacks in applications of the conventional hand tool with a storage compartment in its tool shank is one topic deserving to be studied by the person skilled in the art.

Having considered defects and unideal structural design of a conventional hand tool with a storage compartment in its tool shank, the inventor designed a storage compartment sleeve structure in a tool shank as one solution with features of convenient operation and adjustable torque for the general public and development of the industry.

SUMMARY OF THE INVENTION

A storage compartment sleeve structure in a tool shank in the present disclosure is effective in easily and fast exposing or covering storage compartments in a tool shank from which spare parts are removed and adjusting or selecting various torque by a tool shank's flexible lengths.

A storage compartment sleeve structure in a tool shank is characteristic of the following technical measures for the above purposes: an operation unit with a pin; a tool shank linking the operation unit and developing at least a tool compartment; a tool shank sleeve encasing the tool shank and developing a positioning through hole penetrated by the pin.

A storage compartment sleeve structure in a tool shank further comprises an inner sleeve held between the tool shank and the tool shank sleeve and developing an inner through hole which is penetrated by a corresponding support pin for positioning the tool shank.

In the present disclosure, the operation unit comprises a neck which allows the pin and further a joint pin penetrating a joint hole on the tool shank to be installed and comprises a circular coupler coupled with a corresponding C-shaped circular groove at the top end of the tool shank.

In the present disclosure, the tool shank comprises a shank part located at the rear part for installation of the support pin.

In the present disclosure, the tool shank develops a longitudinal open slot; the pin or the support pin allows its pin rod and a spring to be held in a pilot hole: the spring resists the pin rod and gives it elastic energy; the pilot hole prevents the pin rod from bounce by limiting its movement.

A storage compartment sleeve structure in a tool shank further comprises the following technical measures: an operation unit; a tool shank linking the operation unit, developing at least a tool compartment and coupled with a support pin; an inner sleeve encasing the tool shank and developing an inner through hole penetrated by the support pin.

The storage compartment sleeve structure in a tool shank further comprises a tool shank sleeve enveloping the inner sleeve and developing a positioning through hole which corresponds to and engages with a pin on the operation unit.

In the present disclosure, the operation unit comprises a neck which allows the pin and further a joint pin penetrating a joint hole on the tool shank to be installed and comprises a circular coupler coupled with a corresponding C-shaped circular groove at the top end of the tool shank.

In the present disclosure, the tool shank comprises a shank part located at the rear part for installation of the support pin.

In the present disclosure, the tool shank develops a longitudinal open slot; the support pin or the pin allows its pin rod and a spring to be held in a pilot hole: the spring resists the pin rod and gives it elastic energy; the pilot hole prevents the pin rod from bounce by limiting its movement.

For technical features and effects in terms of the present disclosure completely comprehended and recognized, the preferred embodiments and accompanying drawings are thoroughly described hereinafter.

DETAILED DESCRIPTION OF THE PREFERRED EMBODIMENTS

Figure 1:
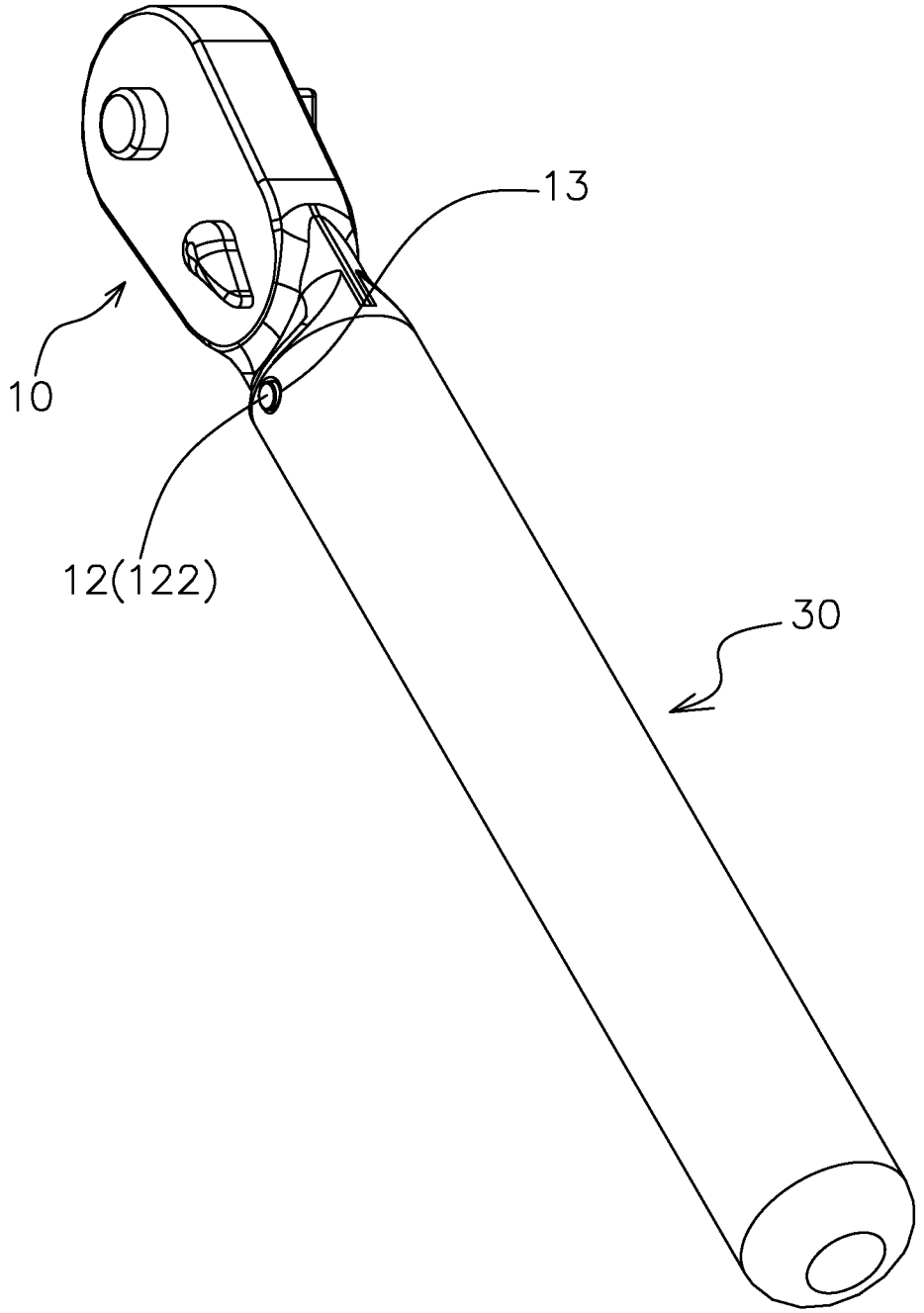
FIG. 1 is a perspective view illustrating a storage compartment sleeve structure in a tool shank.
Figure 2:
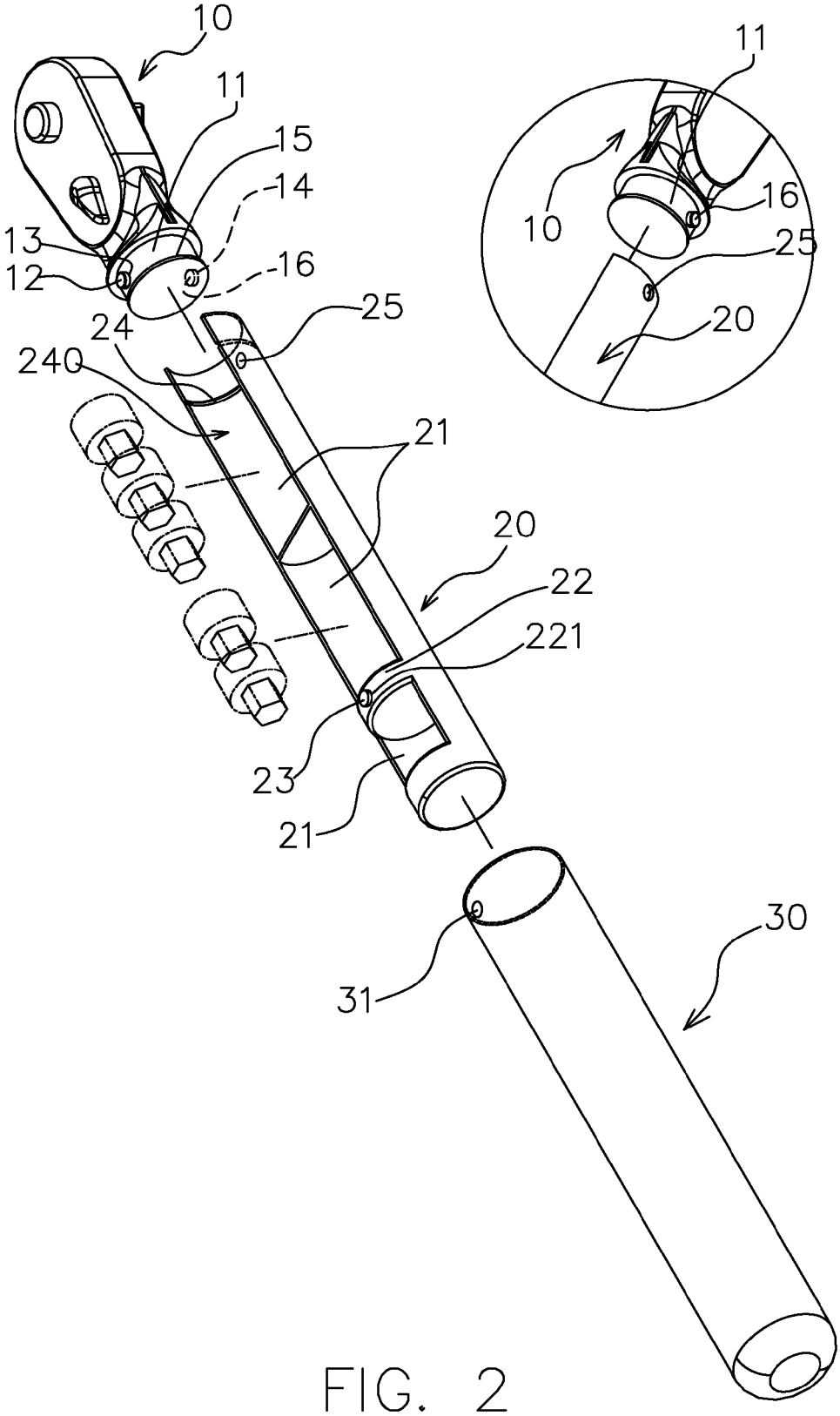
FIG. 2 is an exploded view illustrating a storage compartment sleeve structure in a tool shank.
Figure 3:
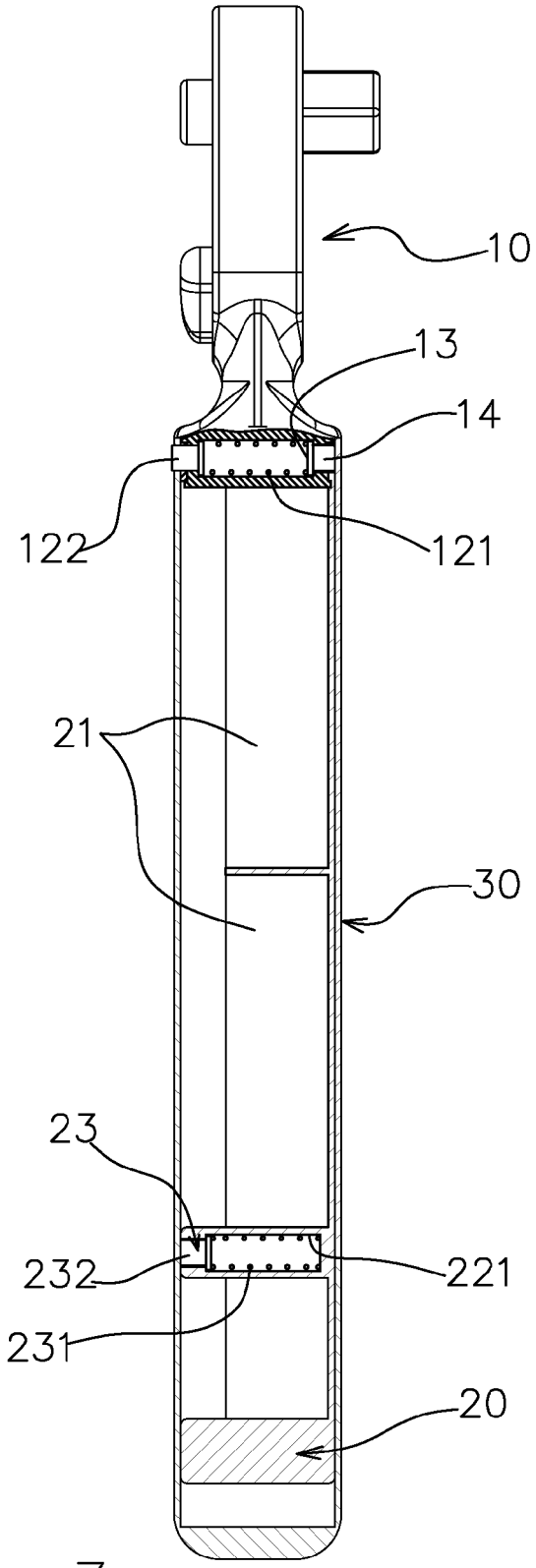
FIG. 3 is sectional view illustrating a storage compartment sleeve structure in a tool shank in the first embodiment.

Please refer to FIG. 1 through FIG. 3 which illustrate the first embodiment of a storage compartment sleeve structure in a tool shank comprising an operation unit 10, a tool shank 20 and a tool shank sleeve 30. The operation unit 10 which is a socket wrench in the figures is probably changed to be other tools including, without limitation, screw driver, handle, file, hammer, combination wrench, box end wrench or ratchet wrench in other embodiments, developing a neck 11 with a pilot hole 13 opened at the front side for accommodation of a pin 12. As shown in FIG. 3, the pin 12 comprises a spring 121 and a pin rod 122, both of which are held in the pilot hole 13: the spring 121 resists the pin rod 122 and gives it elastic energy; the pilot hole 13 prevents the pin rod 122 from bounce by limiting its movement. The neck 11 is equipped with a circular coupler 15 at the end (or a proper location) and comprises a pilot hole 14 (at the back) and a joint pin 16 therein, both of which constitute a combination relation as do the pilot hole 13 and the pin 12.

The tool shank 20 linking the operation unit 10 comprises a longitudinal open slot 240 for development of one or a plurality of tool compartments 21, which coordinate applications of the operation unit 10 for accommodation of spare parts or widgets such as sleeves, nuts, screws and iron nails, a C-shaped circular groove 24 at the top inner side, and a through joint hole 25 at top. The tool shank 20 to be assembled allows its front end to be inserted into the neck 11 of the operation unit 10 and the circular groove 24 to be coupled with the circular coupler 15 on the operation unit 10 so that the joint pin 16 is simply positioned in the joint hole 25 and the tool shank 20 joins the operation unit 10. Moreover, the method to combine the circular groove 24 and the circular coupler 15 is like coupling of a ring slot and a rib or other similar components, each of which can be replaced by an analogous component. In this embodiment, the tool shank 20 can be disassembled from or coupled with the operation unit 10 when the joint pin 16 is pushed and pressed. In an alternative embodiment, the tool shank 20 is integrated with the operation unit 10 or coupled with the operation unit 10 via other components, for example, the tool shank 20 and the operation unit 10 are provided with butt joints (not shown in the figure) opposite to and screwed into each other, or the tool shank 20 comprising a male square butt joint on which an elastic ball is laterally installed engages with the operation unit 10 comprising a female square butt joint with a slot corresponding to the elastic ball for secure connection between the tool shank 20 and the operation unit 10 (not shown in the figure). In this disclosure, the method to join the tool shank 20 and the operation unit 10 is not limited to a, specific manner. Furthermore, the open slot 240 at the front end of the tool shank 20 which is coupled with the operation unit 10 makes the pin 12 exposed for penetration of the tool shank sleeve 30 (as hereunder mentioned particularly).

As shown in the second embodiment for greater torques applied, the tool shank 20 further develops a shank part 22 located at a rear part of the tool shank 20 and between two adjacent tool compartments 21 or other proper positions and comprising a pilot hole 221 in which a support pin 23 is inserted. The support pin 23 comprises a spring 231 and a pin rod 232, both of which are held in the pilot hole 221: the spring 231 resists the pin rod 232 and gives it elastic energy; the pilot hole 221 prevents the pin rod 232 from bounce by limiting its movement.

The tool shank sleeve 30 in which the tool shank 20 is held develops a positioning through hole 31 at the front end and envelops the tool shank 20 from behind so that the positioning through hole 31 at the front end is penetrated by the pin 12 linking the operation unit 10 for completion of positioning the tool shank sleeve 30.

The pin 12 (or the joint pin 16 or the support pin 23) has a pin rod with a curved end atop by which an engagement or release action is easily activated; preferably, the pin rod develops a ball end or a cylindrical body with a curved end.

The method of exposing the tool compartments 21 of a storage compartment sleeve structure in a tool shank is to push and press the pin 12, allowing the positioning through hole 31 to be not resisted by the pin 12. With the tool shank sleeve 30 removed and the positioning through hole 31 securely penetrated by the support pin 23, the tool compartments 21 are exposed for removal or accommodation of spare parts or widgets. In the storage compartment sleeve structure in a tool shank, the tool shank sleeve 30 presenting a major area to be grasped by one hand can be removed backward so that the tool compartments 21 are exposed conveniently and fast without drawbacks of a conventional device.

Furthermore, one or a number of minor doors (not shown in the figure) which are installed on one or a plurality of tool compartments 21 in the tool shank 20 are used to expose or cover the tool compartment(s) 21; or some rubber pieces (not shown in the figure) installed on both sides of the tool compartment(s) 21 are used to clip or fix spare parts or widgets such as sleeves, nuts, screws and iron nails to be held inside. Accordingly, a storage compartment sleeve structure in a tool shank in the present disclosure develops an extended handgrip structure for applications of greater torques with the tool shank sleeve 30 removed and the positioning through hole 31 securely penetrated by the support pin 23.

Figure 4:
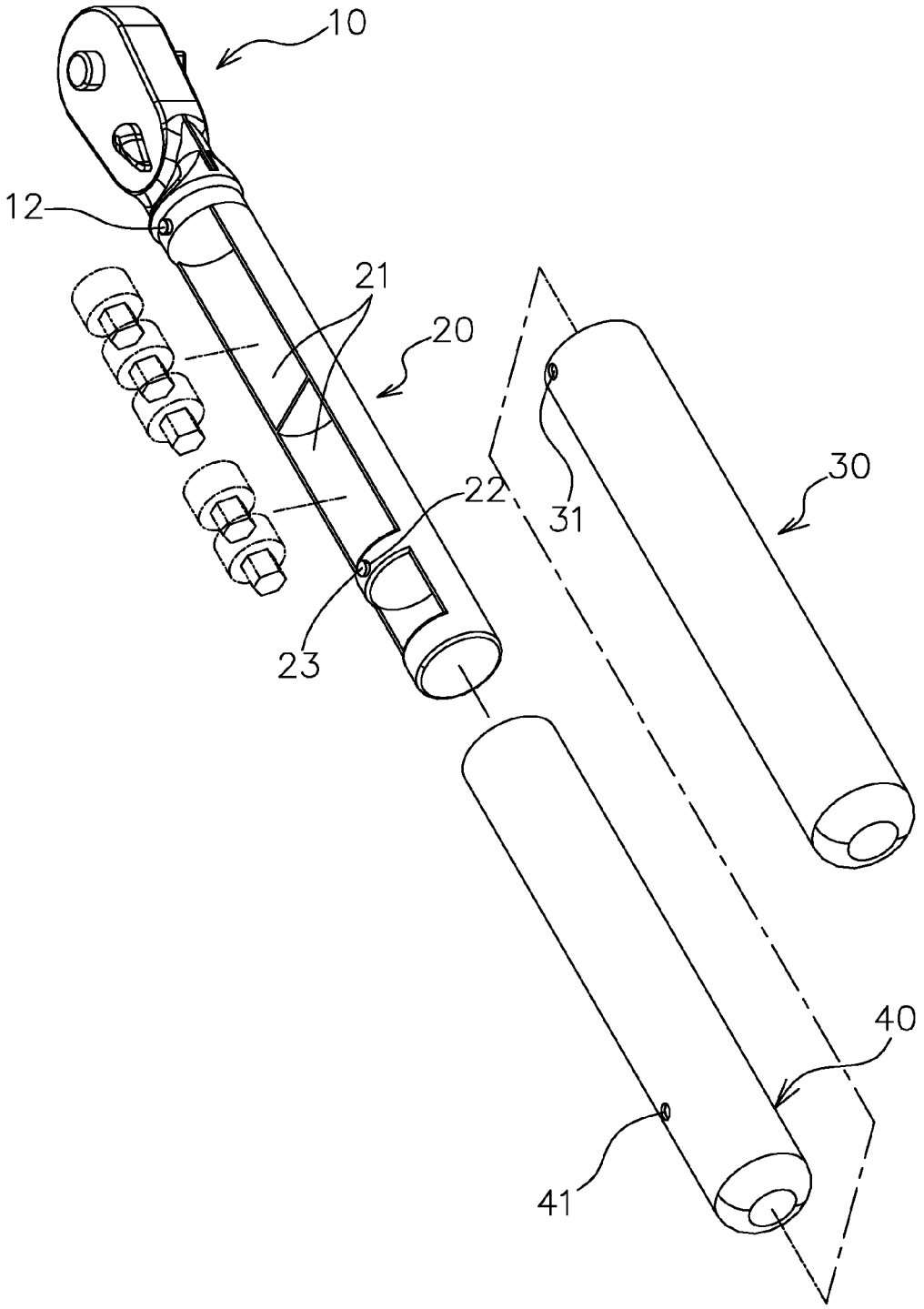
FIG. 4 is an exploded view illustrating a storage compartment sleeve structure in a tool shank in the second embodiment.
Figure 5:
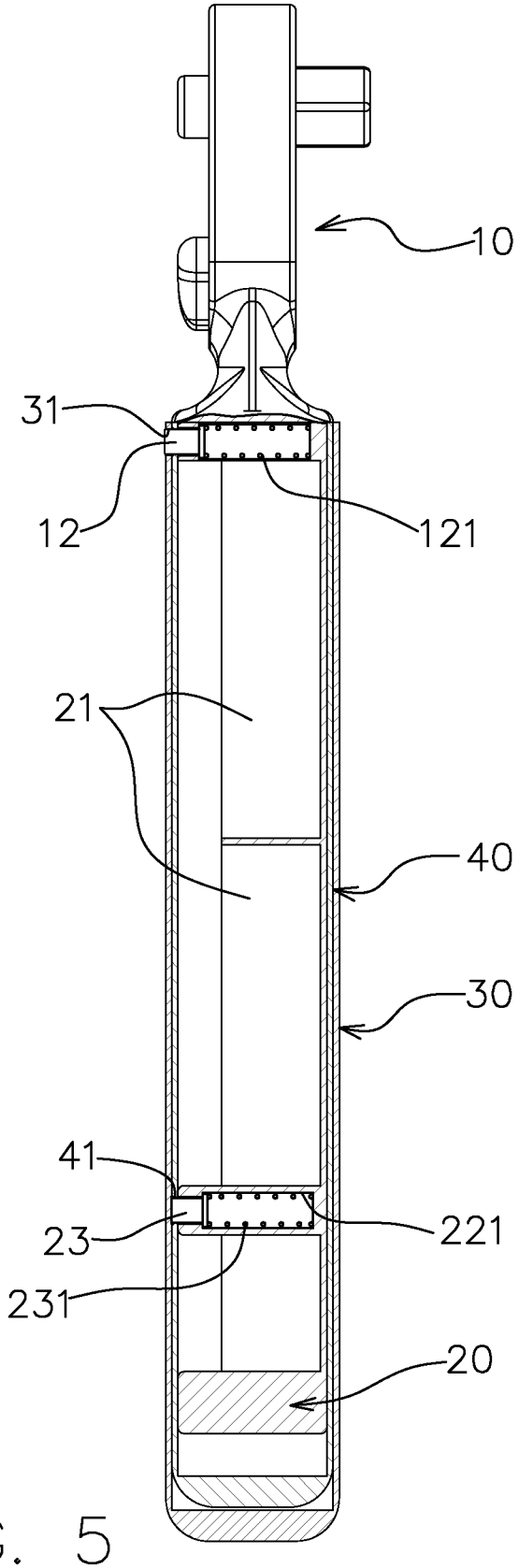
FIG. 5 is a sectional view illustrating a storage compartment sleeve structure in a tool shank in the second embodiment.
Figure 6:
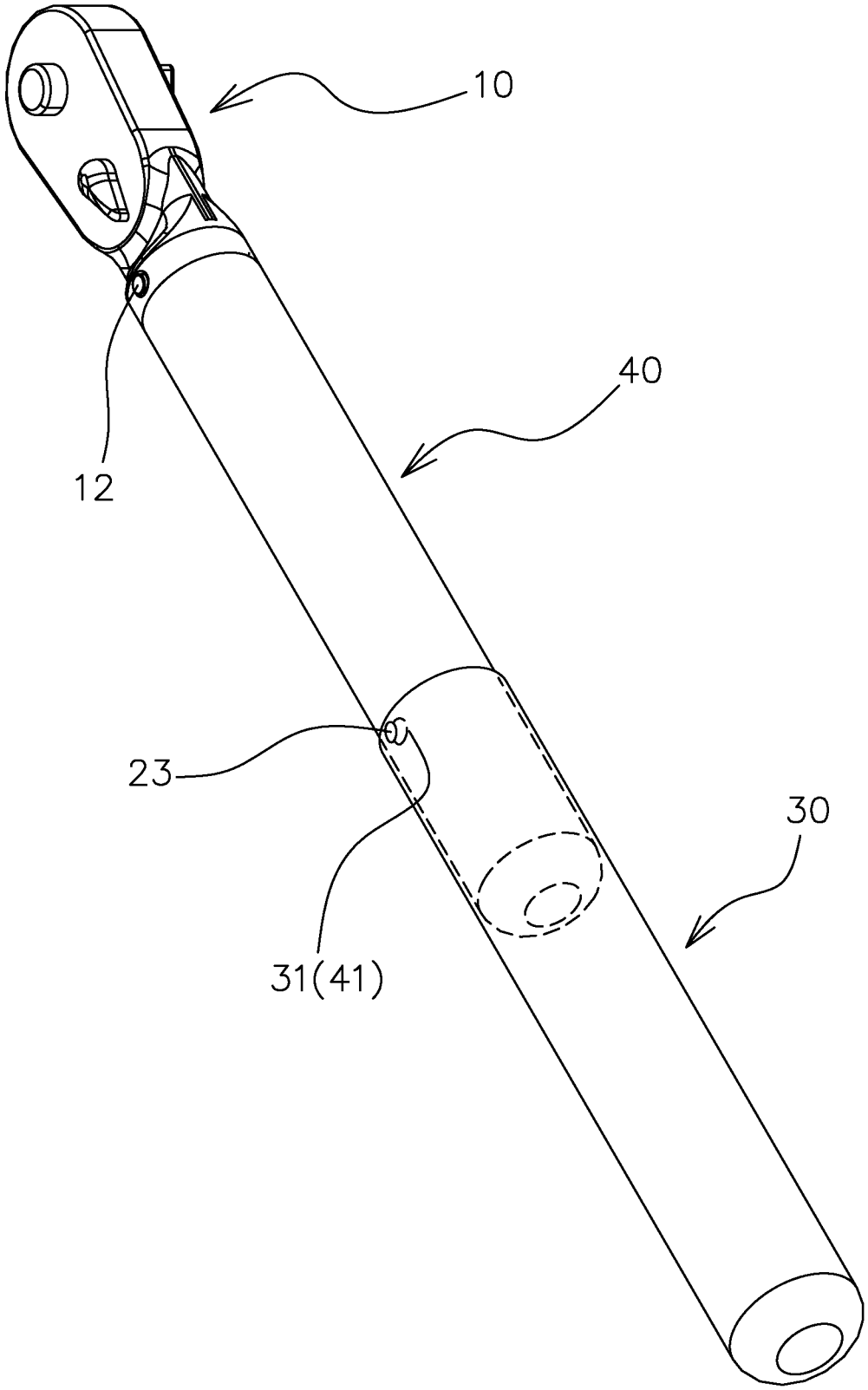
FIG. 6 is a schematic view illustrating an application of a storage compartment sleeve structure in a tool shank.

Please refer to FIG. 4 through FIG. 6 which illustrate a storage compartment sleeve structure in a tool shank in the second embodiment based on the first embodiment for applications of greater torques but different from the first one as shown hereinafter. In the second embodiment, the storage compartment sleeve structure in a tool shank further comprises an inner sleeve 40 linking the tool shank 20 or held between the tool shank 20 and the tool shank sleeve 30 and developing an inner through hole 41 which is located at its rear section and opposite to the support pin 23; the inner sleeve 40 which envelops the tool shank 20 from behind allows the inner through hole 41 thereon to be penetrated by the support pin 23 on the tool shank 20 for completion of holding and positioning the inner sleeve 40 and then is encased by the tool shank sleeve 30 from behind which is simultaneously held and positioned by the pin 12 via the positioning through hole 31 for completion of holding and positioning the inner sleeve 40 again. The inner sleeve 40 less than the tool shank sleeve 30 in length has its front end assembled with the tool shank 20 behind the top end of the tool shank sleeve 30 as well as the pin 12, exposing the pin 12 which can be penetrated and fixed by the tool shank sleeve 30.

Figure 7:
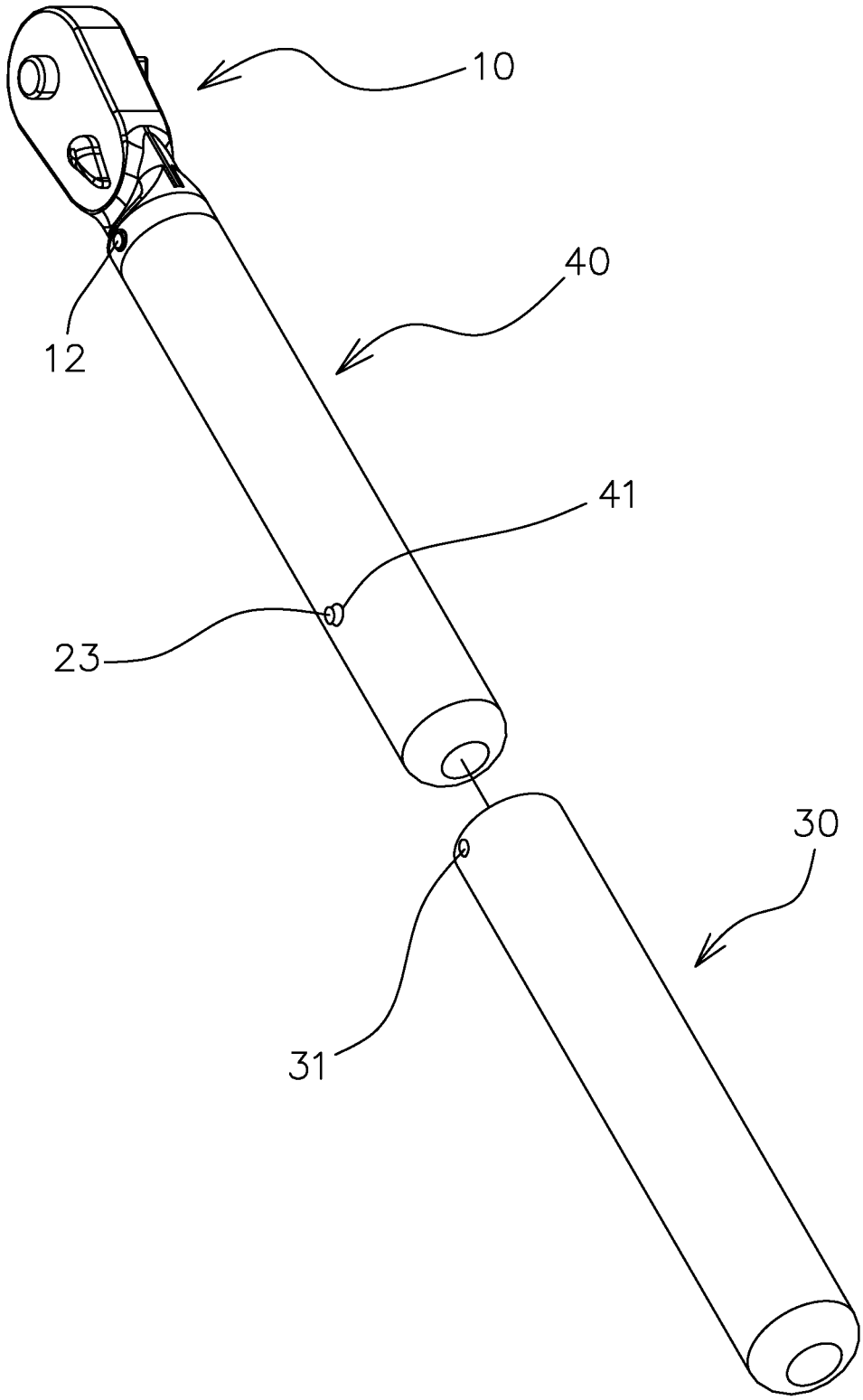
FIG. 7 is a schematic view illustrating another application of a storage compartment sleeve structure in a tool shank.

In the case of a greater torque to be applied by the storage compartment sleeve structure in a tool shank, the pin 12 which is pushed and pressed will not resist the positioning through hole 31 on the tool shank sleeve 30 in order to draw the tool shank sleeve 30 outward (FIG. 6) and fix the backward moved positioning through hole 31 by the support pin 23. The inner sleeve 40 and the tool shank sleeve 30, both of which stretch and become an extended structure, make the tool shank extensive by which the application of a torque is easy. Simultaneously, the spare parts or widgets can be held in or removed from the tool compartments 21 when the support pin 23 activated by a pressure makes the inner sleeve 40 move backward and the tool shank sleeve 30 retreat behind the support pin 23. Next, the inner sleeve 40 should be enveloped in the tool shank sleeve 30 under a pressure so that the tool shank resumes its initial length with the pin 12 held in the positioning through hole 31 on the tool shank sleeve 30 again. As shown in FIG. 7, the storage compartment sleeve structure in a tool shank is still effective in various operations after the tool shank sleeve 30 is separated from the inner sleeve 40, for example, spare parts or widgets are held or removed with the support pin 23 pushed and pressed for backward movement of the inner sleeve 40 because of the tool shank 20 enveloped and fixed by the inner sleeve 40.

In the embodiments disclosed hereinbefore, a storage compartment sleeve structure in a tool shank is described in the sequence of the tool shank sleeve 30 installed first and the inner sleeve 40 added later. In the other hand, the storage compartment sleeve structure in a tool shank still works well with the inner sleeve 40 installed first and the tool shank sleeve 30 added later in an alternative preferred embodiment. Both embodiments contribute to descriptions of spare parts or widgets held in or removed from the storage compartment sleeve structure in a tool shank as well as application of a greater torque for more forces saved.

Therefore, a storage compartment sleeve structure in a tool shank in the present disclosure is effective in easily and fast exposing or covering storage compartments in a tool shank from which spare parts are removed and adjusting or selecting various torque by a tool shank's flexible lengths.

Accordingly, the present invention significantly meets patentability and is applied for the patent. However, the above descriptions are preferred embodiments which do not limit the scope of the storage compartment sleeve structure in a tool shank; any equivalent change or improvement without departing from spirit of the present disclosure should be incorporated in claims herein.

What is claimed is:

1. A storage compartment sleeve structure in a tool shank, comprising:

an operation unit with a pin, said operation unit comprises a neck, a joint pin and a circular coupler, said neck which allows said pin;

a tool shank linking said operation unit and developing at least a tool compartment, said joint pin penetrating a joint hole on said tool shank to be installed and is provided with said circular coupler coupled with a corresponding C-shaped circular groove at said tool shank's top end;

a tool shank sleeve encasing said tool shank and developing a positioning through hole which is penetrated by said pin.

2. A storage compartment sleeve structure in a tool shank according to claim 1 wherein said tool shank is positioned by a support pin which penetrates a corresponding positioning through hole on said tool shank sleeve.

3. A storage compartment sleeve structure in a tool shank according to claim 2 wherein said tool shank develops a longitudinal open slot and said pin or said support pin allows its pin rod and a spring to be held in a pilot hole: said spring resists said pin rod and gives it elastic energy; said pilot hole prevents said pin rod from bounce by limiting its movement.

4. A storage compartment sleeve structure in a tool shank according to claim 1 further comprises an inner sleeve held between the tool shank and the tool shank sleeve and developing an inner through hole which is penetrated by a corresponding support pin for positioning said tool shank.

5. A storage compartment sleeve structure in a tool shank according to claim 1 wherein said tool shank comprises a shank part located at the rear part for installation of said support pin.

6. A storage compartment sleeve structure in a tool shank, comprising:

an operation unit, said operation unit comprises a neck, a joint pin and a circular coupler, said neck which allows said pin;

a tool shank linking said operation unit, developing at least a tool compartment and coupled with a support pin, said joint pin penetrating a joint hole on said tool shank to be installed and is provided with said circular coupler coupled with a corresponding C-shaped circular groove at said tool shank's top end;

an inner sleeve encasing said tool shank and developing an inner through hole penetrated by said support pin.

7. A storage compartment sleeve structure in a tool shank according to claim 6 further comprises a tool shank sleeve enveloping said inner sleeve and developing a positioning through hole which corresponds to and engages with a pin on said operation unit.

8. A storage compartment sleeve structure in a tool shank according to claim 7 wherein said tool shank develops a longitudinal open slot and said support pin or said pin allows its pin rod and a spring to be held in a pilot hole: said spring resists said pin rod and gives it elastic energy; said pilot hole prevents said pin rod from bounce by limiting its movement.

9. A storage compartment sleeve structure in a tool shank according to claim 6 wherein said tool shank comprises a shank part located at the rear part for installation of said support pin.

* * * * *